US005876213A

United States Patent [19]

Matsumoto

[11] Patent Number: 5,876,213

[45] Date of Patent: Mar. 2, 1999

[54] KARAOKE APPARATUS DETECTING REGISTER OF LIVE VOCAL TO TUNE HARMONY VOCAL

[75] Inventor: Shuichi Matsumoto, Hamamatsu, Japan

[73] Assignee: Yamaha Corporation, Hamamatsu, Japan

[21] Appl. No.: 688,388

[22] Filed: Jul. 30, 1996

[30] Foreign Application Priority Data

Jul. 31, 1995 [JP] Japan ..... 7-195064

[51] Int. Cl.[6] ..... G09G 5/00; G10H 1/36

[52] U.S. Cl. ..... 434/307 A; 434/307 R; 84/610; 84/609; 84/631; 704/209; 704/261; 381/63

[58] Field of Search ..... 434/307 R, 309, 434/318, 365; 84/477 R, 601–619, 630–634, 664, 625, 626; 369/32, 48, 178, 192; 381/51, 61–63; 704/209, 261, 267

[56] References Cited

U.S. PATENT DOCUMENTS

| | | | |
|---|---|---|---|
| 5,296,643 | 3/1994 | Kuo et al. | 434/307 A |
| 5,447,438 | 9/1995 | Watanabe et al. | 434/307 A |
| 5,477,003 | 12/1995 | Muraki et al. | 434/307 A |
| 5,525,062 | 6/1996 | Ogawa et al. | 434/307 A |
| 5,621,182 | 4/1997 | Matsumoto | 84/610 |
| 5,641,927 | 6/1997 | Pawate et al. | 84/609 |
| 5,686,684 | 11/1997 | Nagata et al. | 84/631 |
| 5,712,437 | 1/1998 | Kageyama | 84/610 |
| 5,719,346 | 2/1998 | Yoshida et al. | 84/631 |
| 5,739,452 | 4/1998 | Nagata | 84/610 |
| 5,741,992 | 4/1998 | Nagata | 84/631 |
| 5,750,912 | 5/1998 | Matsumoto | 84/609 |
| 5,753,845 | 5/1998 | Nagata et al. | 84/626 |

*Primary Examiner*—Joe H. Cheng
*Attorney, Agent, or Firm*—Pillsbury Madison & Sutro LLP

[57] ABSTRACT

A karaoke apparatus is constructed to perform a karaoke accompaniment part and a karaoke harmony part for accompanying a live vocal part. A pickup device collects a singing voice of the live vocal part. A detector device analyzes the collected singing voice to detect a musical register thereof at which the live vocal part is actually performed. A harmony generator device generates a harmony voice of the karaoke harmony part according to the detected musical register so that the karaoke harmony part is made consonant with the live vocal part. A tone generator device generates an instrumental tone of the karaoke accompaniment part in parallel to the karaoke harmony part.

20 Claims, 7 Drawing Sheets

FIGURE 6A
| |
|---|
| HEADER |
| ACCOMPANIMENT SOUND DATA TRACK |
| LYRIC DISPLAY DATA TRACK |
| HARMONY PART DATA TRACK 1 |
| HARMONY PART DATA TRACK 2 |
| ⋮ |
| HARMONY PART DATA TRACK n |
| PART ANALYSIS DATA TRACK 1 |
| PART ANALYSIS DATA TRACK 2 |
| ⋮ |
| PART ANALYSIS DATA TRACK m |
FIGURE 6B
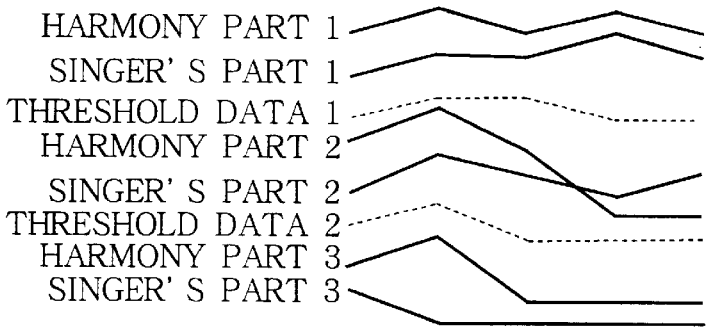
FIGURE 6C
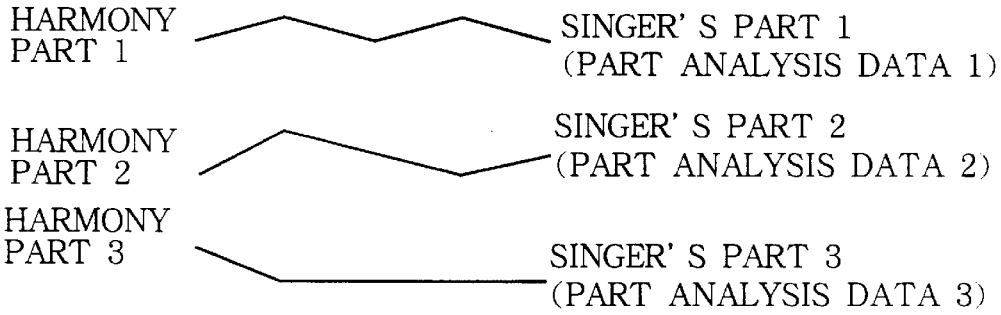

FIGURE 7

| |
|---|
| HEADER |
| ACCOMPANIMENT SOUND DATA TRACK |
| LYRIC DISPLAY DATA TRACK |
| HARMONY PART DATA TRACK |
| PART ANALYSIS DATA TRACK |

FIGURE 8

| |
|---|
| HEADER |
| ACCOMPANIMENT SOUND DATA TRACK |
| LYRIC DISPLAY DATA TRACK |
| HARMONY PART DATA TRACK |

KARAOKE APPARATUS DETECTING REGISTER OF LIVE VOCAL TO TUNE HARMONY VOCAL

BACKGROUND OF THE INVENTION

The present invention relates to a karaoke apparatus, and more particularly relates to a karaoke apparatus which can automatically add synthetic harmony voices to a karaoke singer's live voice.

Conventional karaoke apparatuses have various facilities to show up a karaoke performance. The facilities include a harmony voice generation to add a synthetic harmony voice to a karaoke singer's live voice. The harmony voice generation is performed by creating a harmony voice having a certain pitch difference such as 3rd or 5th degree relative to a melody line of the main live vocal while tracking the melody line. In another method, a harmony voice recorded in advance is reproduced in synchronization with the progress of the karaoke performance. Further, if the karaoke song includes two or more vocal parts, it is possible to reserve one vocal part for the karaoke singer to take that part, while the other part is contained in the song data as an accompaniment harmony sound.

In the harmony generation by the main vocal melody tracking, the main vocal line can be superposed with the harmony voice of a certain pitch shifted, for example, an upper 3rd degree in response to the melody tracking. However, in case of a female karaoke singer, if the harmony voice of the upper 3rd or 5th degree is always generated, the generated harmony voice may incidentally exceed the highest frequency of the audible range. In case of a male karaoke singer, if the harmony voice of the lower 3rd or 5th degree is always generated, the generated harmony voice may incidentally exceed the lowest frequency of the audible range. Further, simple generation of the harmony voice at parallel 3rd or 5th degree may create an unnatural melody line.

In the harmony generation by pre-recording a harmony part, the pre-recorded harmony part may sound consonant with the main vocal part of a certain musical register, but may not sound consonant with the main vocal part of another musical register. A karaoke singer may often transpose the main vocal part by an octave to fit the melody line with his/her range of the voice. In such a case, the generated harmony voice may not sound consonant with the transposed melody line.

Sometimes, it is very hard to recognize which part of the karaoke song is performed as the live vocal part, particularly in a karaoke song having multiple vocal parts. In this sort of the karaoke song, it cannot easily be predicted which part of the song will be sung by the karaoke singer, so that occasionally the generated harmony part and the karaoke singer's live part are overlapped with each other. Further, multiple vocal parts may be composed such as to cross over with each other in some repertories. On the other hand, a karaoke singer may sing an upper part unconditionally, or the singer may confuse the upper and lower parts in a song. In case that the karaoke singer sings such a song, the singer switches his/her live part between two parallel parts in the song, so that some section of the harmony vocal part may be overlapped with some section of the live vocal part.

SUMMARY OF THE INVENTION

The purpose of the present invention is to provide a karaoke apparatus capable of mixing optimum harmony voices harmonizing with the karaoke singer's voice by modifying or tuning the harmony voice depending upon the actual singing voice.

According to the invention, the karaoke apparatus is constructed to perform a karaoke accompaniment part and a karaoke harmony part for accompanying a live vocal part. The karaoke apparatus comprises a pickup device that collects a singing voice of the live vocal part, a detector device that analyzes the collected singing voice to detect a musical register thereof at which the live vocal part is actually performed, a harmony generator device that generates a harmony voice of the karaoke harmony part according to the detected musical register so that the karaoke harmony part is made consonant with the live vocal part, and a tone generator device that generates an instrumental tone of the karaoke accompaniment part in parallel to the karaoke harmony part. In the inventive karaoke apparatus, the register of the singing voice is detected to tune the harmony voice. For example, the register is detected in terms of one of multiple vocal parts. The harmony voice is generated in matching with the detected vocal part so that the harmony voice is made well consonant with the live singing voice and the instrumental accompaniment tone.

In a form of the inventive karaoke apparatus, the harmony generator device comprises storing means for storing a plurality of harmony data patterns corresponding to a plurality of melodic lines differently registered in the karaoke harmony part, selecting means for selecting one of the harmony data patterns according to the detected musical register of the singing voice, and generating means for generating the harmony voice according to the selected harmony data pattern along the corresponding melodic line. Namely, the inventive karaoke apparatus prestores the multiple of the harmony data patterns. An optimum one of the harmony data patterns is selected according to the detected register of the live singing voice. The harmony voice is synthesized according to the selected harmony data pattern to thereby conform well with the singing voice.

In another form of the inventive karaoke apparatus, the harmony generator device comprises storing means for storing a harmony data pattern which represents a sequence of notes to define the karaoke harmony part, shifting means for pitch-shifting the sequence of notes according to the detected musical register of the singing voice to thereby tune the harmony data pattern, and generating means for generating the harmony voice according to the tuned harmony data pattern. Namely, the pitch or frequency of the initial karaoke harmony part is shifted according to the detected register to create the tuned or modified karaoke harmony part. Thus, the harmony voice can be generated in matching with the register of the singing voice with a minimum data volume of the harmony data pattern.

In still another form of the inventive karaoke apparatus, the detector device comprises comparing means for comparing a pitch of the collected singing voice with a reference data which defines different musical registers in a range of the live vocal part so as to determine one musical register to which the collected singing voice belongs. The detector device further comprises providing means for sequentially providing the reference data in synchronization with progression of the karaoke accompaniment part so as to continuously detect the musical register of the collected singing voice to thereby keep the karaoke harmony part consonant with the live vocal part throughout the progression of the karaoke accompaniment part. Namely, the pitch range of the live vocal part is divided into a plurality of pitch zones according to the plurality of the reference or threshold data. The register or the melody line of the singing voice is detected in terms of the pitch zone to which the singing voice belong. By such a construction, the register is accurately detected even if the pitch of the singing voice fluctuates.

BRIEF DESCRIPTION OF THE DRAWINGS

FIGS. 6A, 6B and 6C are an explanatory diagram illustrating a song data format employed in the karaoke apparatus.

FIG. 7 is an explanatory block diagram illustrating the song data format employed in the karaoke apparatus.

FIG. 8 is an explanatory block diagram illustrating the song data format employed in the karaoke apparatus.

DETAILED DESCRIPTION OF THE INVENTION

Figure 1:
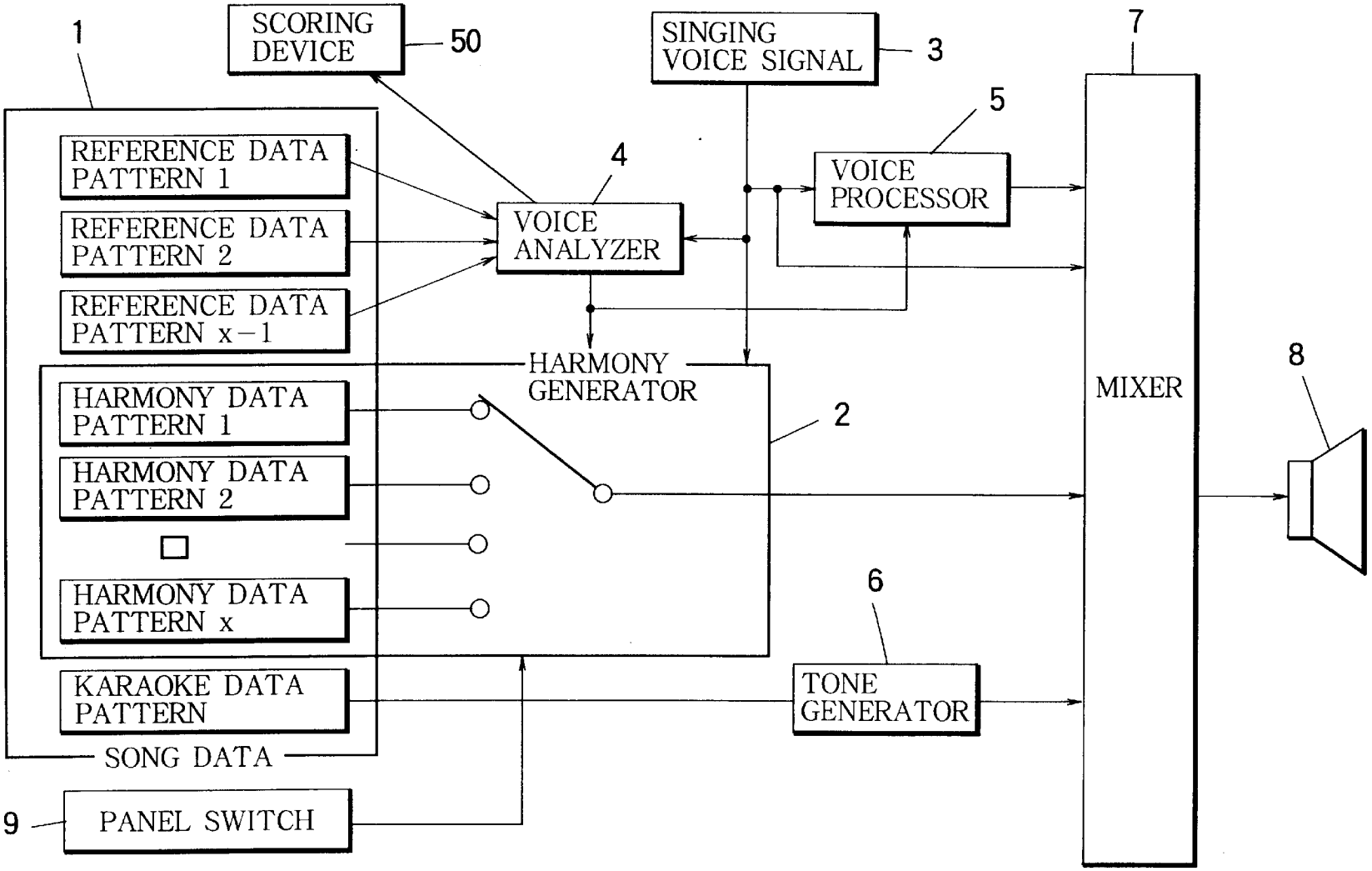
FIG. 1 is an explanatory block diagram illustrating construction of a main part of a karaoke apparatus according to the present invention.

The basic arrangement of the present invention will be described with reference to FIGS. 1 to 3. FIG. 1 illustrates a karaoke apparatus utilizing a song data comprised of a multiple of harmony data patterns, and a multiple of reference data patterns corresponding to each of the multiple harmony data patterns a part by part. The song data denoted by numeral 1 contains the multiple harmony data patterns, the multiple reference data patterns, and a karaoke data pattern to reproduce an instrumental accompaniment sound. In the beginning of a karaoke performance, the karaoke data pattern is fed to a tone generator 6 in order to generate the accompaniment sound. The generated accompaniment sound is audibly reproduced through a mixer 7 and a speaker 8. A karaoke singer sings a karaoke song with listening to the accompaniment sound. The singing voice signal denoted by numeral 3 is fed to the mixer 7, a voice analyzer 4, a voice processor 5, and a harmony generator 2.

The voice analyzer 4 compares the input singing voice signal 3 with the multiple of the reference data patterns in order to analyze musical register of the singing voice. The reference data pattern may be a sort of a melody line of one part going up and down in synchronism with the progression of the karaoke song likewise the harmony data pattern of one part. For example, the reference data pattern of one part may be described in a MIDI data format or another data format such as a melody track of polyphonic karaoke song data. The register detection or part analysis can be carried out according to various methods. For example, the simplest method is such that the register of the singing voice signal is detected as a corresponding part when the singing voice signal coincides with a certain reference data pattern, which is described in a melody line format in advance. Alternative simple method is such that the reference data pattern is provided in the form of plural threshold data patterns defining different voice registers. The part or register of the singing voice is detected by evaluating to which of the defined registers the singing voice signal belongs. The result of the analysis by the voice analyzer 4 is sent to the harmony generator 2 and the voice processor 5. The harmony generator 2 selects one of the multiple harmony data patterns contained in the song data in response to the input analysis result. In this selection, the optimum harmony data pattern is selected to well harmonize with the analyzed singing voice. The harmony generator 2 may generate the harmony voice signal by processing or modifying the input singing voice signal. Otherwise, the harmony generator 2 reproduces the harmony voice signal pre-recorded in advance. The voice processor 5 imparts sound effects to the singing voice signal. The effects may be selected from a reverb, a formant conversion carried out in response to the analysis result by the voice analyzer 4 and so on. For example, in the formant conversion, it is possible to replace the female (male) formant with the male (female) formant in case a female (male) singing voice is collected. With this formant conversion, gender of the live singing voice can be converted into that of the original singer of the karaoke song.

The harmony generator 2 is connected to a panel switch 9 which is manually operated to select a desired harmony part. In case that the harmony vocal part is manually selected by the switch 9, the harmony voice signal of the selected harmony vocal part is generated in spite of whatever analysis result is derived by the voice analyzer 4. A scoring device 50 evaluates the karaoke singing based on the analysis result of the voice analyzer 4 and displays scoring results.

Occasionally, one karaoke singer may change to another karaoke singer in the middle of the song, or may change his/her part, or may change a voice pitch by an octave. Fundamentally, the register detection or part analysis can follow these changes so that the reproduced harmony part is switched in response to the register change. However, a sudden switching of the harmony part may cause unnatural impression to listeners or performers. To avoid this, the harmony part may be switched at a certain transitional timing such as an end of a phrase or melody.

As described above, the inventive karaoke apparatus is constructed to perform a karaoke accompaniment part and a karaoke harmony part for accompanying a live vocal. A pickup device such as a microphone collects the singing voice 3 of the live vocal part. The voice analyzer 4 analyzes the collected singing voice 3 to detect a musical register thereof at which the live vocal part is actually performed. The harmony generator 2 generates a harmony voice of the karaoke harmony part according to the detected musical register so that the karaoke harmony part is made consonant with the live vocal part. The tone generator 6 generates an instrumental tone of the karaoke accompaniment part in parallel to the karaoke harmony part. The harmony generator 2 stores a plurality of harmony data patterns corresponding to a plurality of melodic lines differently registered in the karaoke harmony part, selects one of the harmony data patterns according to the detected musical register of the singing voice, and generates the harmony voice according to the selected harmony data pattern along the corresponding melodic line. For example, the harmony generator 2 selects one harmony data pattern corresponding to a melodic line having a musical register comparable to the detected musical register of the singing voice. The voice analyzer 4 compares a pitch of the collected singing voice with a reference data which defines different musical registers in a range of the live vocal part so as to determine one musical register to which the collected singing voice belongs. The voice analyzer 4 sequentially provides the reference data in synchronization with progression of the karaoke accompaniment part so as to continuously detect the musical register of the collected singing voice to thereby keep the karaoke harmony part consonant with the live vocal part throughout the progression of the karaoke accompaniment part.

Figure 2:
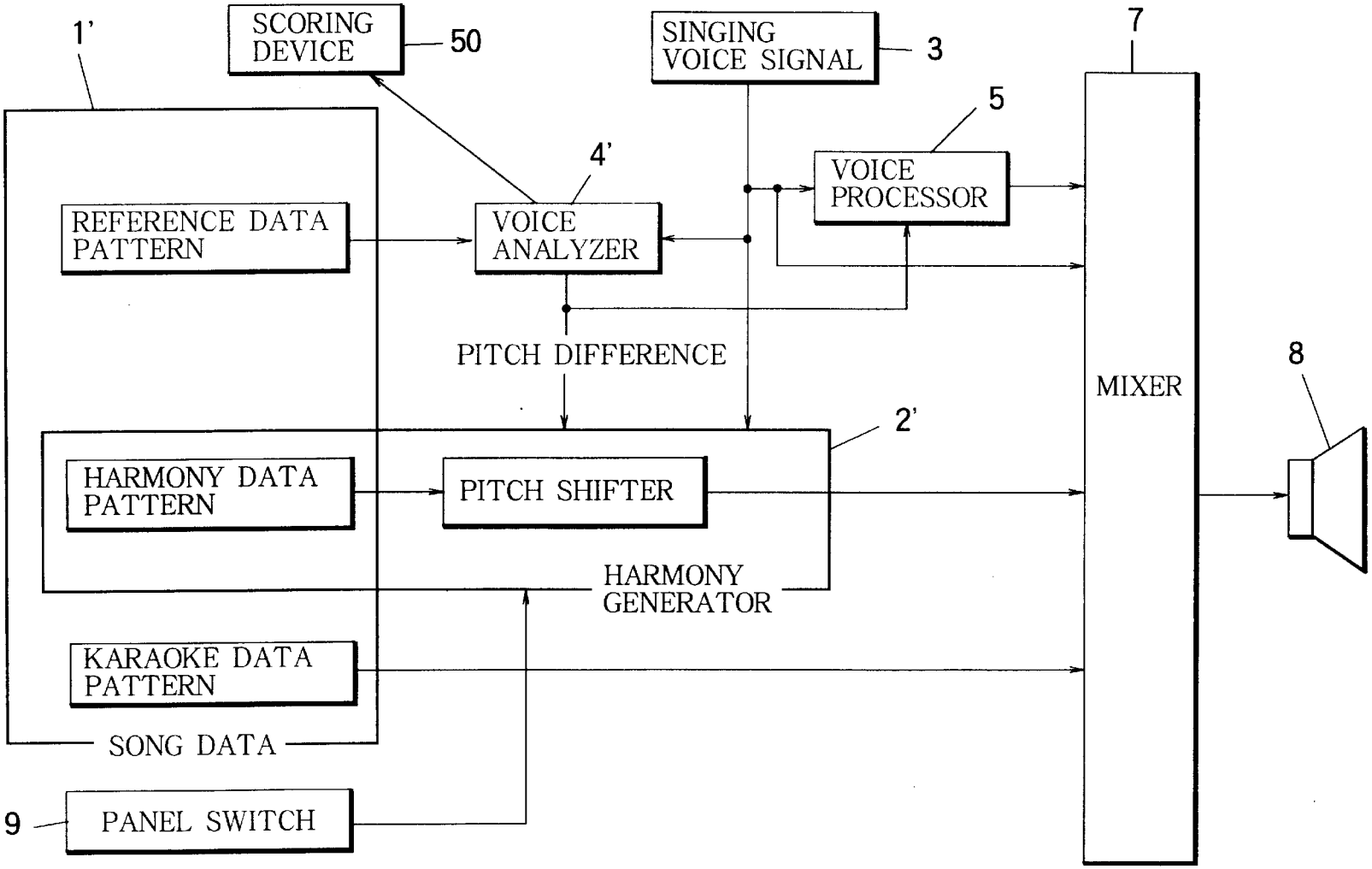
FIG. 2 is another explanatory block diagram illustrating construction of the main part of the inventive karaoke apparatus.

FIG. 2 illustrates another karaoke apparatus which utilizes a song data comprised of a harmony data pattern and a reference data pattern. In FIG. 2, the same blocks as in FIG. 1 are denoted by the same numerals to facilitate better understanding of this embodiment. The song data 1' includes a harmony data pattern, a reference data pattern, and a karaoke data pattern to render the accompaniment sound. A voice analyzer 4' analyzes how many degrees the singing voice signal is higher or lower than the reference data pattern. The voice analyzer 4' may be simplified to detect a register of the singing voice signal in terms of an octave. The voice analyzer 4' computes the pitch difference between the reference data pattern and the singing voice signal, and sends the computed result to a harmony generator 2'. The harmony generator 2' shifts the pitch of the harmony data pattern in response to the input pitch difference in order to determine the pitch of the harmony voice to be rendered. The harmony generator 2' may generate the harmony voice signal by processing or modifying the input singing voice signal, or by reproducing a model harmony voice signal pre-recorded in advance similarly to the harmony generator 2 in FIG. 1.

As described above, in the karaoke apparatus of FIG. 2, the harmony generator 2' stores a harmony data pattern which represents a sequence of notes to define the karaoke harmony part, pitch-shifts the sequence of notes according to the detected musical register of the singing voice in terms of the pitch difference to thereby tune the harmony data pattern, and generates the harmony voice according to the tuned harmony data pattern. The harmony generator 2' includes the pitch shifter for modifying a pitch of the collected singing voice according to the tuned harmony data pattern to generate the harmony voice originating from the singing voice.

Figure 3:
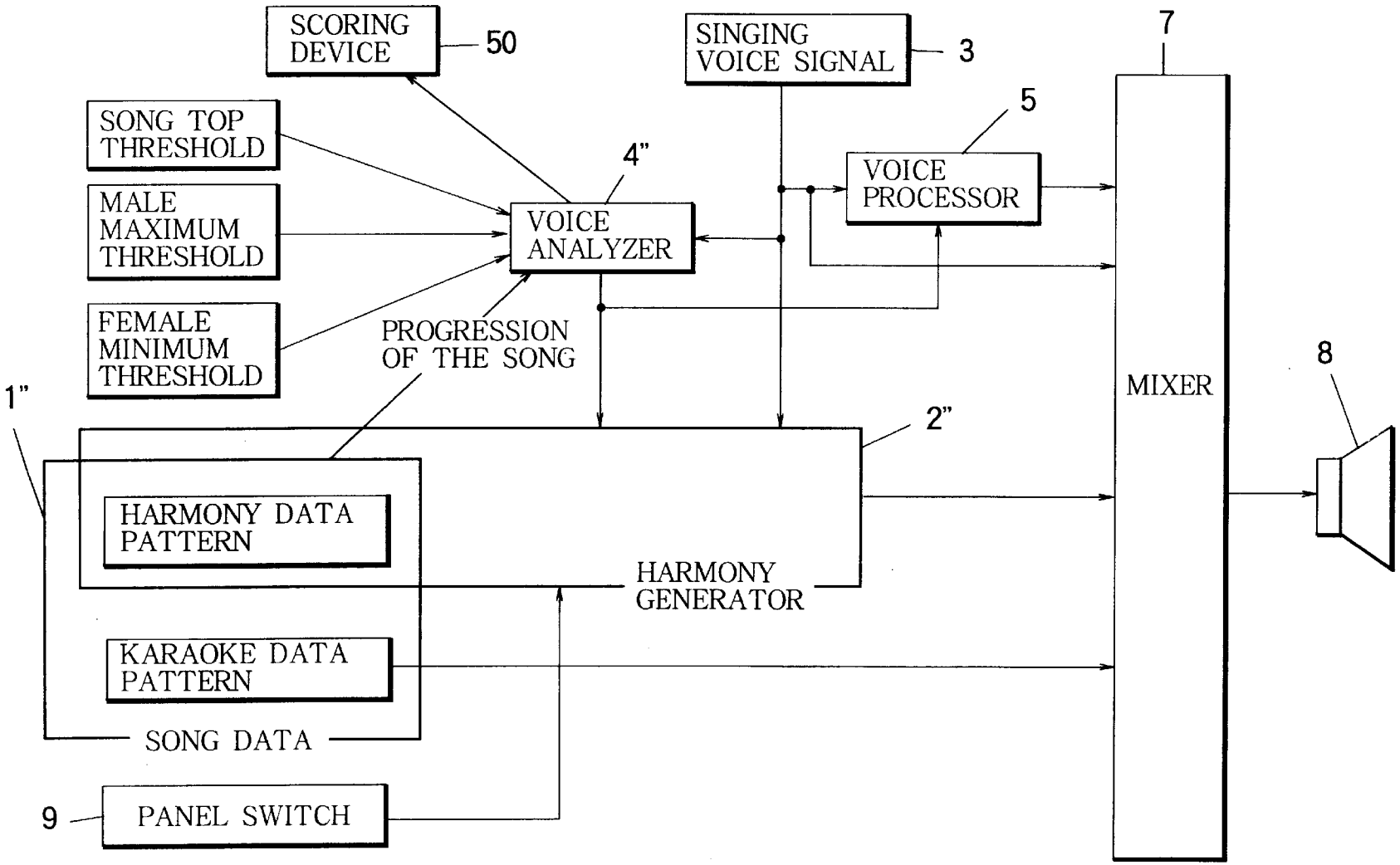
FIG. 3 is still another explanatory block diagram illustrating construction of the main part of the inventive karaoke apparatus.

FIG. 3 illustrates a karaoke apparatus of another embodiment which uses a song data comprised only of a harmony data pattern and a karaoke data pattern. In FIG. 3, the same blocks as in FIG. 1 are denoted by the same numerals, and the detailed description therefor is omitted hereunder. The voice analyzer 4" stores a reference data in the form of three fixed threshold data. The three threshold data are named song top threshold, male maximum threshold, and female minimum threshold. Generally speaking, the vocal melody of an ordinary karaoke song starts at a typical musical register, so that it is possible to detect whether the singer is male or female by detecting the octave of the singing voice signal at the start of the karaoke song performance. Thus, the song top threshold is set at a border of the ordinary male and female registers. The voice analyzer 4" readily detects whether the karaoke singer is male or female at the start of the karaoke singing according to the song top threshold. The vocal melody may contain a sequence of notes having various pitches ranging from high to low. However, if the pitch of the singing voice is too high relative to the male maximum threshold though the singer is initially detected as being male, it may be recognized that the singer is changed or the original detection is wrong. This recognition is done by the male maximum threshold. If the pitch of the singing voice exceeds the male maximum threshold, the singer is detected as being female to cancel the original detection result. On the other hand, if the pitch of the singing voice is too low though the singer is initially detected as being female, it may be recognized that the singer is changed or the original detection is wrong. This recognition is done by the female minimum threshold. If the pitch of the singing voice falls below the female minimum threshold, the singer is detected as being male to cancel the original detection result. The result of the male/female recognition is fed to a harmony generator 2". The harmony generator 2" determines the pitch of the harmony voice signal depending on the detected male/female register in terms of octave.

Thus, in the embodiment shown in FIG. 1, the singing voice signal is analyzed using the multiple reference data patterns in order to select the optimum one of the multiple harmony data patterns depending on the register analysis result, so that the harmony part is made consonant with the singer's vocal part. In the embodiments shown in FIGS. 2 and 3, the harmony voice signal can be tuned by the simple arrangement.

Figure 4:
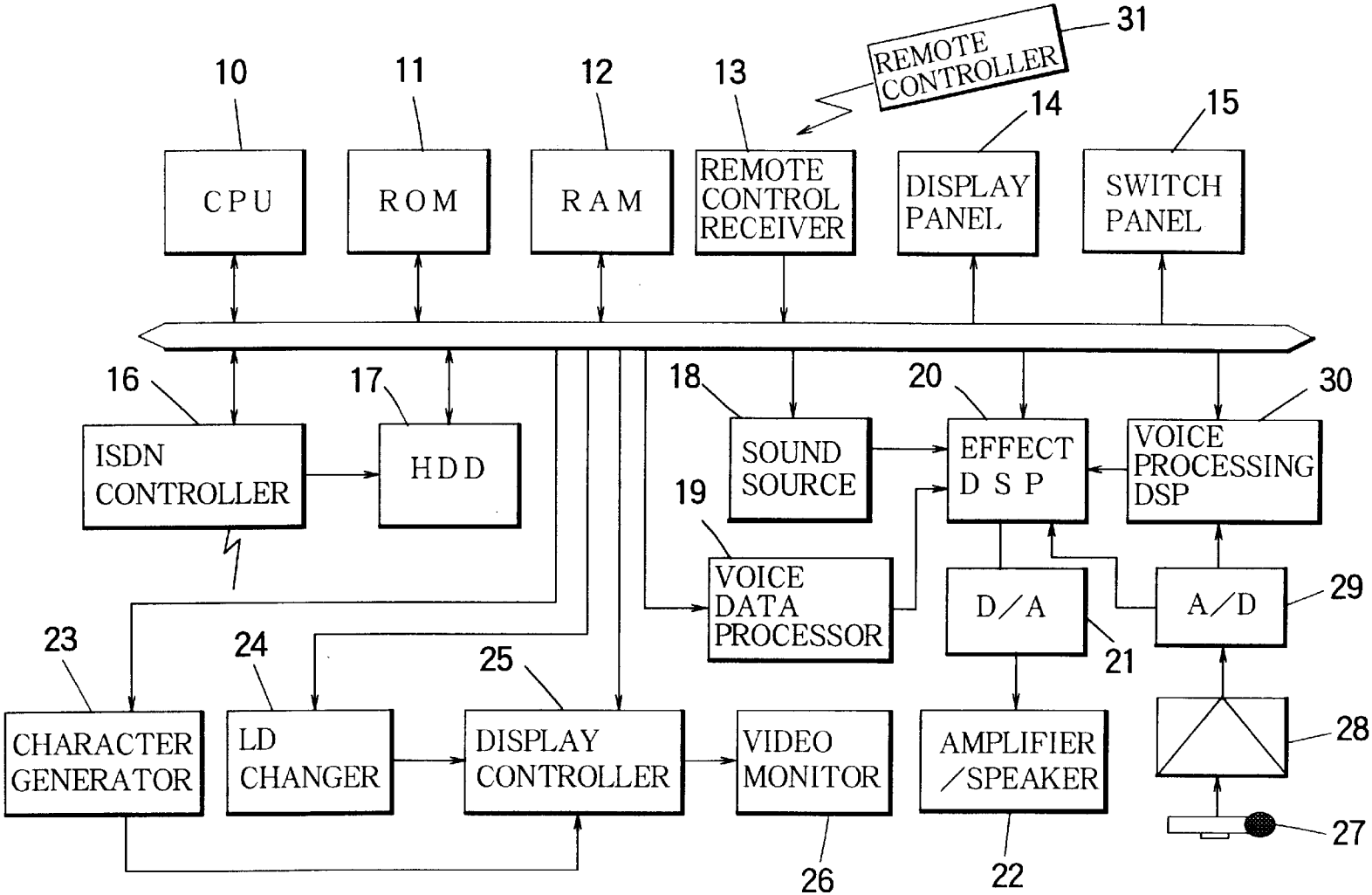
FIG. 4 is an overall block diagram of the karaoke apparatus according to the present invention.

Now the detail of the karaoke apparatus according to the present invention will be explained with reference to FIGS. 4 to 8. The karaoke apparatus is a sound source type in which a communication facility and a harmonizing facility are implemented. In the sound source type of the karaoke apparatus, a song data is fed to a sound source device which reproduces the musical sound for a karaoke performance. The song data is composed of a multiple tracks of sequence data specifying a pitch and a timing of notes. By the communication facility, the karaoke apparatus connects with a host station through a communication network, downloads the song data from the host station, and stores the song data in an HDD (hard disk drive) 17 (FIG. 4). The HDD 17 can store several hundreds to several thousands of the song data files. With the harmonizing facility, the karaoke apparatus generates and reproduces a harmony voice harmonizing with the singer's voice in response to the analysis of the singer's voice.

The format of the song data stored in the HDD 17 will be described hereunder with reference to FIGS. 6A to 8. The song data may be categorized into type I, type II and type III in terms of a number of the reference data patterns for detecting the singer's part or register and a number of the harmony data patterns. The type I of the song data is described with reference to FIG. 1, the type II of the song data is described in FIG. 2, and the type III of the song data is described in FIG. 3.

FIG. 6A shows a format of the song data of the type I. The song data comprises a header, an accompaniment sound data track, a lyric display data track, a multiple of harmony part data tracks corresponding to a multiple of harmony data patterns, and a multiple of part analysis data tracks corresponding to a multiple of reference data patterns. The header contains various bibliographic data relating to the karaoke song including the title of the karaoke song, the genre of the karaoke song, the date of the release of the karaoke song, the performance time (length) of the karaoke song and so on. The accompaniment sound data track contains a sequence data to synthesize the karaoke accompaniment sound. Particularly, the accompaniment sound data track contains parallel instrumental subtracks including a melody track, a rhythm track and so on. Each subtrack contains the sequence data comprised of a note event data and a duration data specifying an interval of each note event. The lyric display data track records a sequence data to display the lyric words of the karaoke song on a video monitor. The song data contains n number of the harmony part data tracks. The harmony part data track stores a pitch sequence data representing a melody line of a corresponding harmony part. The pitch sequence data stored in the harmony part data track is comprised of a combination of an event data commanding note-on or note-off and a pitch of each note. Further, the song data contains m number of the part analysis data tracks. Each part analysis data track stores a sequence data. This sequence data is also implemented as a combination of an event data and a duration data so that the part analysis data track is also kept in synchronization with the progress of the karaoke song performance.

FIGS. 6B and 6C illustrate the relationship among the singer's live part, the harmony part and the analysis part. FIG. 6B shows an example in which the song data contains a multiple of singer's parts 1, 2, and 3, and a multiple of harmony parts 1, 2, and 3 corresponding to the multiple singer's parts. The part analysis data is implemented in the form of threshold data 1 and 2 in order to detect which of the singer's parts 1 to 3 is actually sung by the singer. It is evaluated which of registers defined by the threshold data 1 and 2 covers the singing voice signal in order to detect the part that the singer is actually singing, and in order to select the corresponding harmony counterpart.

In another example shown in FIG. 6C, the multiple of the singer's parts are utilized as they are for both of the analysis data parts and the harmony parts. If the karaoke singer sings a certain one of the multiple singer's parts, the karaoke apparatus detects that part actually sung by the singer, and selects another part as a harmony part to be performed.

As can be seen from FIGS. 6B and 6C, the harmony data in these examples does not represent a simple parallel 3rd or 5th counterpart melody relative to the singer's part, but represents a melody composed uniquely to the singer's part to match well with the singer's part from the musical point of view on the melodic or harmonic aspect of the karaoke song.

FIG. 7 shows an example of the song data of the type II. The song data comprises a header, an accompaniment sound data track, a lyric display data track, a harmony part data track, and a part analysis data track. The header, the accompaniment sound data track and the lyric display data track are formed similarly as in the song data of the type I. Only one harmony part data track is provided in this example. The harmony voice signal is generated by shifting the pitch of the harmony part data at a certain degree (normally an octave) depending on the musical register in which the singer is actually singing the vocal part. The part or register sung by the karaoke singer is detected according to the pitch difference between the singing voice signal and the pitch analysis data. The melody line of the harmony part may be the same as that of the karaoke singer's part as in the case of FIG. 6C.

FIG. 8 shows an example of the song data of the type III. The song data comprises a header, an accompaniment sound data track, a lyric display data track, and a harmony part data track. The header, the accompaniment sound data track and the lyric display data track are formed similarly as in the type I of the song data. The harmony melody line prescribed in the harmony part data track is pitch-shifted to create the harmony voice signal as in the case of the type II of the song data. Since the part analysis data is not included in the song data, the part sung by the singer is detected by comparing the singer's voice signal with fixed thresholds stored in a part analyzer. The harmony part data track is pitch-shifted to make the harmony voice signal consonant with the detected singer's part.

The karaoke apparatus according to the present invention supports any of the above described three types of the song data. The part sung by the karaoke singer is detected according to different analysis methods specific to each song data type so as to tune the harmony part in harmonization with the detected live vocal part or the register thereof.

FIG. 4 is a detailed schematic block diagram of the karaoke apparatus. A CPU 10 controls the whole system through its system bus. The CPU 10 is connected to a ROM 11, a RAM 12, an HDD (hard disk drive) 17, an ISDN controller 16, a remote control receiver 13, a display panel 14, a switch panel 15, a sound source 18, a voice data processor 19, an effect DSP 20, a character generator 23, an LD changer 24, a display controller 25, and a voice processing DSP 30.

The ROM 11 stores system programs, application programs, a loader program and font data. The system program controls the basic operation of the system and data transaction between peripheral devices and the system. The application programs include peripheral device controllers, sequence programs and so on. In the karaoke performance, each sequence program is executed by the CPU 10 to reproduce the musical sound and video image according to the song data. With the loader program, song data are loaded from a host station through the ISDN controller 16. The font data is used to display lyrics and song titles. Various fonts such as 'Mincho' and 'Gothic' are stored as the font data. A work area is allocated in the RAM 12. The HDD 17 stores the song data files.

The ISDN controller 16 controls the communication with the host station through an ISDN network. Various data including the song data are downloaded from the host station. The ISDN controller 16 accommodates a DMA controller which writes data and programs such as the downloaded song data and application programs directly into the HDD 17 without the control of the CPU 10.

The remote control receiver 13 receives infrared control signals transmitted by a remote controller 31, and decodes the received control signals. The remote controller 31 is provided with ten-key switches and command switches such as a song selector switch. The remote controller 31 transmits the infrared control signal modulated by command codes corresponding to the user's operation of the switches. The display panel 14 is provided at the front face of the karaoke apparatus. The display panel 14 displays a song code of the karaoke song currently playbacked, a number of the songs reserved to be playbacked and so on. The switch panel 15 is provided on a front operation panel of the karaoke apparatus. The switch panel 15 includes a song code input switch, a singing key transpose switch and so on.

The sound source 18 is composed of a tone generator to generate the accompaniment sound according to the song data distributed by the CPU 10. The voice data processor 19 generates back chorus voice signals or else having a specified length and pitch corresponding to chorus voice data included in the song data. The voice data is formed of an ADPCM waveform data of a backing chorus or else which is hard to synthesize by the sound source 18, and which is digitally encoded as it is.

A microphone 27 collects or picks up the singing voice signal of the karaoke singer. The collected singing voice signal is fed to the voice processing DSP 30 through a preamplifier 28 and an A/D converter 29. Additionally to the singing voice signal, the DSP 30 also receives the part analysis data and the harmony part data from the CPU 10. The voice processing DSP 30 detects the part sung by the karaoke singer according to the input part analysis data, and generates a harmony voice signal harmonizing with the singer's part. The harmony voice signal is generated by shifting the pitch of the singer's voice signal. The generated harmony voice signal is fed to the effect DSP 20.

The effect DSP 20 receives the accompaniment sound signal generated by the sound source 18, the backing chorus voice signal generated by the voice data processor 19, and the harmony voice signal generated by the voice processing DSP 30. The effect DSP 20 imparts various sound effects such as an echo and a reverb to the sound and voice signals. The type and depth of the sound effects imparted by the effect DSP 20 is controlled based on an effect control data included in the accompaniment sound track of the song data. The effect-imparted accompaniment sound and voice signals are converted into an analog signal in a D/A converter 21, and are then fed to an amplifier/speaker 22. The amplifier/speaker 22 acoustically reproduces the input analog signal with amplification.

The character generator 23 generates character patterns representative of a song title and lyrics corresponding to input character data. The LD changer 24 accommodates about five laser discs containing 120 scenes, and can selectively reproduce approximately 120 scenes of the background video image. The LD changer 24 receives an image selection data determined dependently upon the genre data included in the song data. The LD changer 24 selects one background video image from the 120 scenes of the video images, and visually reproduces the video image. The generated character pattern data and the selected video image data are sent to the display controller 25. The display controller 25 superposes the two input data with each other, and displays the composite image on the video monitor 26.

Figure 5:
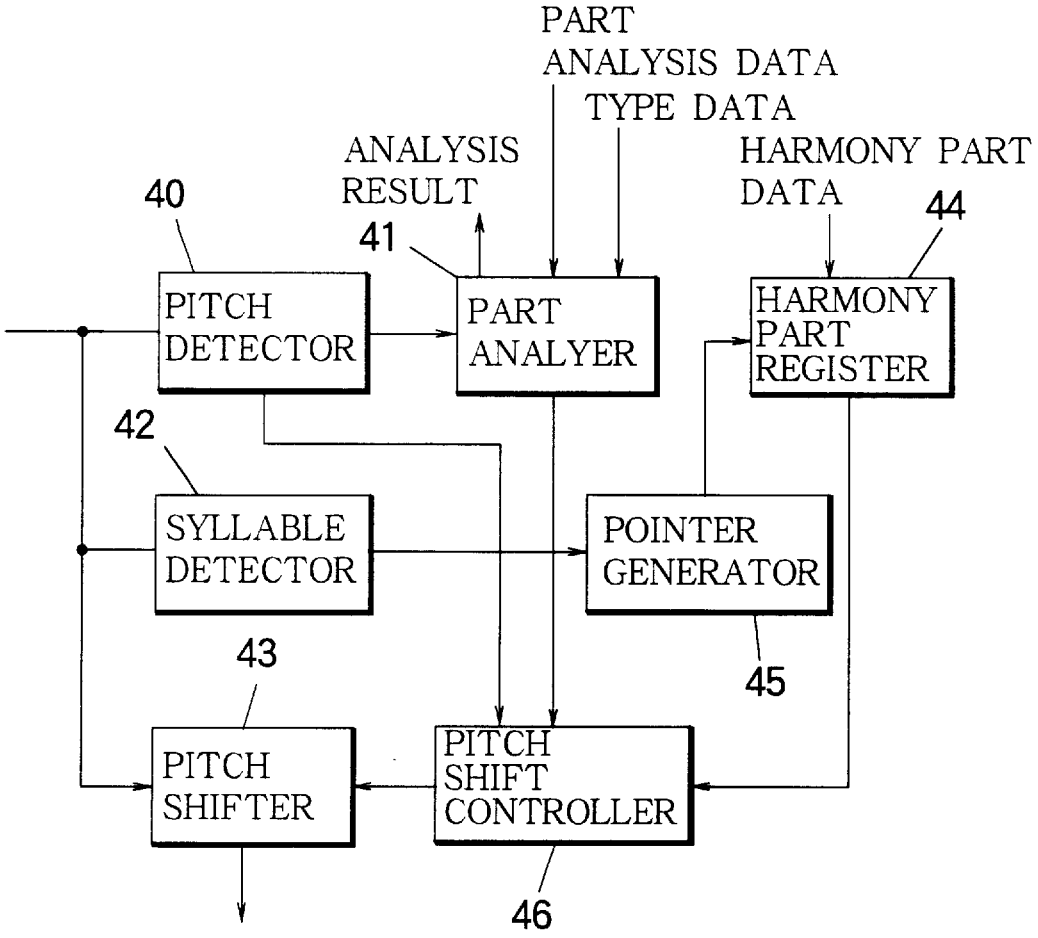
FIG. 5 is an explanatory block diagram illustrating function of a voice processing DSP employed in the karaoke apparatus.

FIG. 5 illustrates the detailed structure of the voice processing DSP 30. The voice processing DSP 30 analyzes the input singing voice signal in order to generate an audio signal of a harmony part consonant with the singing voice signal. In FIG. 5, the voice processing DSP 30 is illustrated functionally by blocks. These functions are actually implemented by microprograms of the DSP.

The singing voice signal provided through the A/D converter 29 is fed to a pitch detector 40, a syllable detector 42, and a pitch shifter 43. The pitch detector 40 detects a pitch or frequency of the input singing voice signal. The syllable detector 42 detects each syllable contained in the input singing voice signal. The syllables are detected by discriminating consonants and vowels depending upon their phonetic characteristics. The pitch shifter 43 shifts the pitch of the input singing voice signal to generate the harmony voice signal harmonizing with the input singing voice signal. Thus, the collected karaoke singer's voice is output as it is through one channel, and is also pitch-shifted by the voice processing DSP 30 to be converted into the harmony voice signal harmonizing with the singer's voice in parallel to the accompaniment sound signal.

The pitch information detected by the pitch detector 40 is fed to a part analyzer 41 and a pitch shift controller 46. The part analyzer 41 receives reference information about the song data type (I to III) and the part analysis data. The part analyzer 41 analyzes and detects the part of the karaoke song sung by the karaoke singer according to the song data type information and the pitch information detected by the pitch detector 40. The part analysis method will be described later in detail.

The result of the part analysis by the part analyzer 41 is fed back to the CPU 10, and then fed to the pitch shift controller 46. In case of the type I of the song data, the CPU 10 selects one of the harmony part data tracks, and transfers the selected harmony part data to a harmony part register 44 included in the voice processing DSP 30. In case of the type II or III of the song data, only one harmony part data track is stored so that the harmony part data of the sole track is sent to the harmony part register 44 of the voice processing DSP 30.

The harmony part data stored in the harmony part register 44 is read out in response to an address pointer generated by a pointer generator 45, and is then fed to the pitch shift controller 46. The pointer generator 45 increments the address pointer in response to the syllable information generated by the syllable detector 42. Thus, the melody line of the harmony part does not progress in synchronization with a constant tempo clock, but progresses in synchronization with the actual tempo of the karaoke singer's vocal performance so that the generated harmony part synchronizes well with the singer's vocal part even if the singer sings out of the constant tempo.

The pitch shift controller 46 computes a pitch shift amount to be applied to the input singing voice signal depending upon the detected pitch and register of the input singing voice signal and the harmony part data read out from the harmony part register 44 in order to generate a harmony voice signal consonant with the input singing voice and the accompaniment sound. The pitch shift amount computed by the pitch shift controller 46 is fed to the pitch shifter 43 as a pitch shift control data. The pitch shifter 43 shifts the pitch of the collected singing voice signal according to the input pitch shift control data. The pitch-shifted voice signal harmonizes well with the singing voice signal and the accompaniment sound signal provided that the singer is singing the song at the regular pitch. The pitch-shifted voice signal is sent to the effect DSP 20.

Now, the part analysis method and the pitch shift computation method will be explained with respect to each of the song data types I to III. In case of the type I song data shown in FIGS. 6A–6C, a multiple of the part analysis data are distributed to the part analyzer 41. The part analyzer 41 analyzes the register of the singing voice signal according to the part analysis data which define thresholds of different registers. According to the analysis result, a harmony part corresponding to the detected register is selected. The result of the part analysis is sent to the CPU 10. Depending upon the part analysis result, the CPU 10 selects one harmony part out of the harmony part data tracks, reads out the selected harmony part, and sends the same to the harmony part register 44. As for the type I song data, the optimum harmony part is selected out of the multiple harmony part data tracks. The selected harmony part data represents a sequence of absolute pitch data of the harmony melody line. The pitch shift controller 46 computes a pitch difference between the singing voice and the harmony melody line to determine the pitch shift amount applied to the singing voice signal in order to shift the same to the absolute pitch of the selected harmony part. In the explanation above, the part analysis data is assumed to be stored as the threshold data as shown in FIG. 6B. However, if the part analysis data is stored as a multiple of part melody data, it is possible to detect which of the part melody data coincides with the singing voice signal, and it is possible to generate the harmony part other than the detected melody part. The part analyzer 41 continuously analyzes the part or register of the singing voice so that the harmony part can be switched even when the singer transposes his/her melody part in the middle of the singing performance.

With respect to the type II of the song data shown in FIG. 7, the part analyzer 41 computes a pitch difference between the part analysis data and the singing voice signal. A pitch shift adjustment to be applied to the harmony part is determined according to the computed pitch difference. The derived pitch shift adjustment is given to the pitch shift controller 46 as the part analysis result. The harmony data register 44 stores the sole harmony part data prepared for the song. The harmony part data stored in the harmony part register 44 is distributed to the pitch shift controller 46 according to the address pointer fed from the pointer generator 45. The pitch shift controller 46 generates the final pitch shift information according to the pitch difference between the singing voice signal and the harmony part data and according to the pitch shift adjustment distributed by the part analyzer 41. The final pitch shift information is fed to the pitch shifter 43. With this harmony part processing, even when the singer transposes his/her melody part by an octave to sing within the register of his/her voice, the harmony part can adapt to the transposition of the register, and an optimum harmony voice can be generated in the adequate register.

As for the type III of the song data shown in FIG. 8, the song data does not contain the part analysis data. With respect to the type III of the song data, the part analyzer 41 analyzes the register of the singer using fixed three threshold data, which are the male maximum threshold, the female minimum threshold, and the song top threshold. In the beginning of the song, the singer's voice signal is compared with the song top threshold. In this comparison, the singer is detected as being female if the pitch of the singer's voice signal is higher than the song top threshold. If the singer is detected as a female, the absolute pitch of the harmony part is shifted into the female or male register. Particularly, the harmony part is shifted into the female register if the harmony voice of the same gender is required, or shifted into the male register if the harmony voice of the opposite gender is required. On the other hand, the singer is detected as being male if the pitch of the singer's voice signal is lower than the song top threshold. The pitch of the harmony part is shifted to the male or female register similarly to the case of the female singer described above.

The effect DSP 20 may add not only a typical effect such as the reverb, but also a certain special effect such as a formant conversion.

As described above, the karaoke apparatus of the present invention carries out the part analysis to generate the harmony voice signal depending on the number of the harmony part data tracks and the number of the reference data tracks included in the song data. Thus, an optimum harmony voice can be generated for the various types of the song data.

As shown in the foregoing, according to the first aspect of the invention, the musical register of the live singing voice is continuously analyzed to tune a corresponding harmony voice so that it is possible to generate the optimum harmony voice consonant well with the karaoke singing voice. According to the second aspect of the invention, an optimum harmony voice can be generated for all the voice registers, not by merely shifting the singing voice, but by selecting an optimum one of multiple harmony part data. According to the third aspect of the invention, even if the singing voice is raised or lowered an octave, the frequency of the harmony voice can be shifted accordingly so that it is possible to retain an optimum pitch interval between the singing voice and the harmony voice. According to the fourth aspect of the invention, the musical register of the singing voice is detected according to the frequency threshold data varying in synchronism with the karaoke performance. Consequently, it is possible to carry out the harmony part control and the part analysis of the singing voice independently from each other so that the harmony voice totally different from the singing voice can be generated independently upon the melody of the singing voice. Further, it is possible to detect the part of the singing voice even if the singing voice is out of tune provided that the singing voice belongs to a range defined by the thresholds.

What is claimed is:

1. A karaoke apparatus constructed to perform a karaoke accompaniment part and a karaoke harmony part for accompanying a live vocal part, comprising:

a pickup device that collects a singing voice of the live vocal part;

a detector device that analyzes the collected singing voice to detect a musical register thereof at which the live vocal part is actually performed;

a harmony generator device that generates a harmony voice of the karaoke harmony part according to the detected musical register so that the karaoke harmony part is made consonant with the live vocal part; and a tone generator device that generates an instrumental tone of the karaoke accompaniment part in parallel to the karaoke harmony part.

2. A karaoke apparatus according to claim 1, wherein the harmony generator device comprises storing means for storing a plurality of harmony data patterns corresponding to a plurality of melodic lines differently registered in the karaoke harmony part, selecting means for selecting one of the harmony data patterns according to the detected musical register of the singing voice, and generating means for generating the harmony voice according to the selected harmony data pattern along the corresponding melodic line.

3. A karaoke apparatus according to claim 2, wherein the selecting means comprises means for selecting one harmony data pattern corresponding to a melodic line having a musical register comparable to the detected musical register of the singing voice.

4. A karaoke apparatus according to claim 1, wherein the harmony generator device comprises storing means for storing a harmony data pattern which represents a sequence of notes to define the karaoke harmony part, shifting means for pitch-shifting the sequence of notes according to the detected musical register of the singing voice to thereby tune the harmony data pattern, and generating means for generating the harmony voice according to the tuned harmony data pattern.

5. A karaoke apparatus according to claim 4, wherein the generating means comprises means for modifying a pitch of the collected singing voice according to the tuned harmony data pattern to generate the harmony voice originating from the singing voice.

6. A karaoke apparatus according to claim 1, wherein the harmony generator device comprises means for modifying a pitch of the collected singing voice according to the detected musical register thereof to generate the harmony voice.

7. A karaoke apparatus according to claim 1, wherein the harmony generator device comprises means for generating the harmony voice which has a musical register different by one octave from the detected musical register of the singing voice.

8. A karaoke apparatus according to claim 1, wherein the detector device comprises comparing means for comparing a pitch of the collected singing voice with a reference data which defines different musical registers in a range of the live vocal part so as to determine one musical register to which the collected singing voice belongs.

9. A karaoke apparatus according to claim 8, wherein the detector device further comprises providing means for sequentially providing the reference data in synchronization with progression of the karaoke accompaniment part so as to continuously detect the musical register of the collected singing voice to thereby keep the karaoke harmony part consonant with the live vocal part throughout the progression of the karaoke accompaniment part.

10. A karaoke apparatus according to claim 8, wherein the detector device further comprises providing means for initially providing the reference data at the start of the karaoke accompaniment part so as to readily detect the musical register of the collected singing voice.

11. A method of performing a karaoke accompaniment part and a karaoke harmony part for accompanying a live vocal part, comprising the steps of:

collecting a singing voice of the live vocal part;

analyzing the collected singing voice to detect a musical register thereof at which the live vocal part is actually performed;

generating a harmony voice of the karaoke harmony part according to the detected musical register so that the karaoke harmony part is made consonant with the live vocal part; and generating an instrumental tone of the karaoke accompaniment part in parallel to the karaoke harmony part.

12. A method according to claim 11, wherein the step of generating a harmony voice comprises the steps of storing a plurality of harmony data patterns corresponding to a plurality of melodic lines differently registered in the karaoke harmony part, selecting one of the harmony data patterns according to the detected musical register of the singing voice, and generating the harmony voice according to the selected harmony data pattern along the corresponding melodic line.

13. A method according to claim 12, wherein the step of selecting comprises selecting one harmony data pattern corresponding to a melodic line having a musical register comparable to the detected musical register of the singing voice.

14. A method according to claim 11, wherein the step of generating a harmony voice comprises steps of storing a harmony data pattern which represents a sequence of notes to define the karaoke harmony part, pitch-shifting the sequence of notes according to the detected musical register of the singing voice to thereby tune the harmony data pattern, and generating the harmony voice according to the tuned harmony data pattern.

15. A method according to claim 14, wherein the step of generating the harmony voice comprises modifying a pitch of the collected singing voice according to the tuned harmony data pattern to generate the harmony voice originating from the singing voice.

16. A method according to claim 11, wherein the step of generating a harmony voice comprises modifying a pitch of the collected singing voice according to the detected musical register thereof to generate the harmony voice.

17. A method according to claim 11, wherein the step of generating a harmony voice comprises generating the harmony voice which has a musical register different by one octave from the detected musical register of the singing voice.

18. A method according to claim 11, wherein the step of analyzing the collected singing voice comprises comparing a pitch of the collected singing voice with a reference data which defines different musical registers in a range of the live vocal part so as to determine one musical register to which the collected singing voice belongs.

19. A method according to claim 18, wherein the step of analyzing the collected singing voice further comprises sequentially providing the reference data in synchronization with progression of the karaoke accompaniment part so as to continuously detect the musical register of the collected singing voice to thereby keep the karaoke harmony part consonant with the live vocal part throughout the progression of the karaoke accompaniment part.

20. A method according to claim 18, wherein the step of analyzing the collected singing voice further comprises initially providing the reference data at the start of the karaoke accompaniment part so as to readily detect the musical register of the collected singing voice.

* * * * *